US006475101B2

(12) United States Patent
Burrows

(10) Patent No.: US 6,475,101 B2
(45) Date of Patent: Nov. 5, 2002

(54) METAL WOOD GOLF CLUB HEAD WITH FACEPLATE INSERT

(76) Inventor: Bruce D. Burrows, P.O. Box 802948, Santa Clarita, CA (US) 91380-2948

( * ) Notice: Subject to any disclaimer, the term of this patent is extended or adjusted under 35 U.S.C. 154(b) by 0 days.

(21) Appl. No.: 09/905,549

(22) Filed: Jul. 13, 2001

(65) Prior Publication Data

US 2002/0006835 A1 Jan. 17, 2002

Related U.S. Application Data

(60) Provisional application No. 60/218,731, filed on Jul. 17, 2000, and provisional application No. 60/286,323, filed on Apr. 24, 2001.

(51) Int. Cl.[7] ..... A63B 53/04

(52) U.S. Cl. ..... 473/334; 473/337; 473/342; 473/345

(58) Field of Search ..... 473/324, 333, 473/334, 335, 336, 337, 338, 339, 340, 349, 350, 256, 290, 291, 342, 345, 346

(56) References Cited

U.S. PATENT DOCUMENTS 3,652,094 A * 3/1972 Glover
4,195,842 A * 4/1980 Coleman
4,944,515 A * 7/1990 Shearer
5,242,167 A * 9/1993 Antonious
5,482,282 A * 1/1996 Willis
5,570,886 A * 11/1996 Rigal
5,776,011 A * 7/1998 Su
5,839,974 A * 11/1998 McAllister
5,935,019 A * 8/1999 Yamamoto
6,261,192 B1 * 7/2001 Otani

* cited by examiner

*Primary Examiner*—Sebastiano Passaniti
(74) *Attorney, Agent, or Firm*—Kelly Bauersfeld Lowry & Kelley, LLP

(57) ABSTRACT

A golf club head is provided of the metal wood type, wherein a faceplate of the club head carries a weighted insert. In one form, a weighted insert is mounted into a forwardly open cavity formed in the faceplate and defines a front end visible from the exterior of the club head and disposed substantially coplanar with the club head faceplate. In another form, the weighted insert is formed integrally at the interior or inboard side of the faceplate may be associated with indicia visible from the exterior of the club head to indicate the location thereof.

12 Claims, 6 Drawing Sheets

FIG. 1
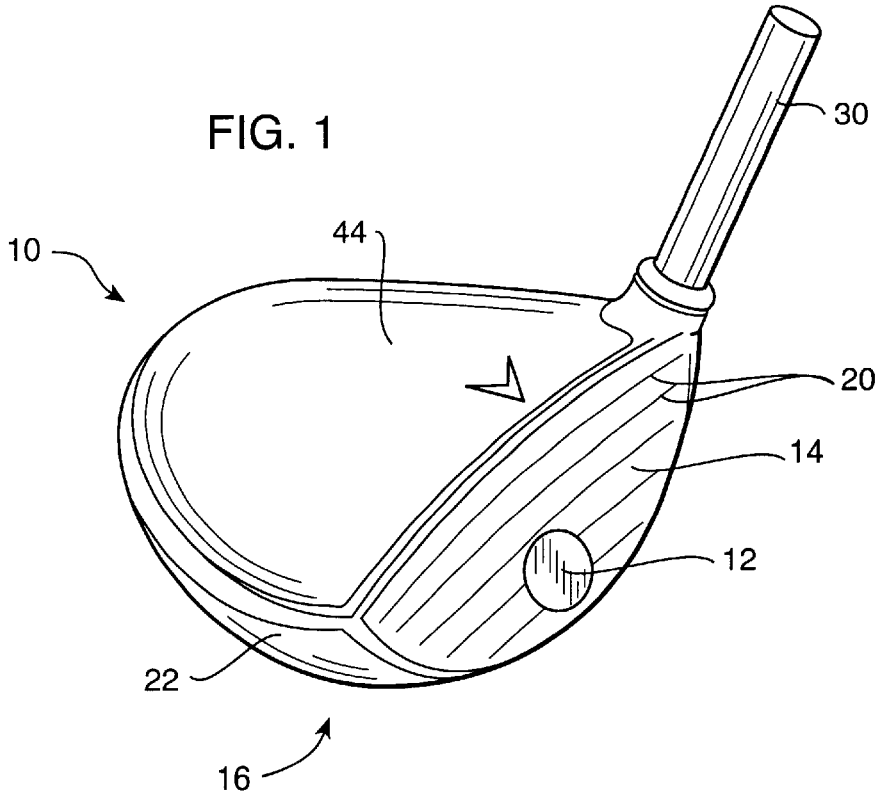
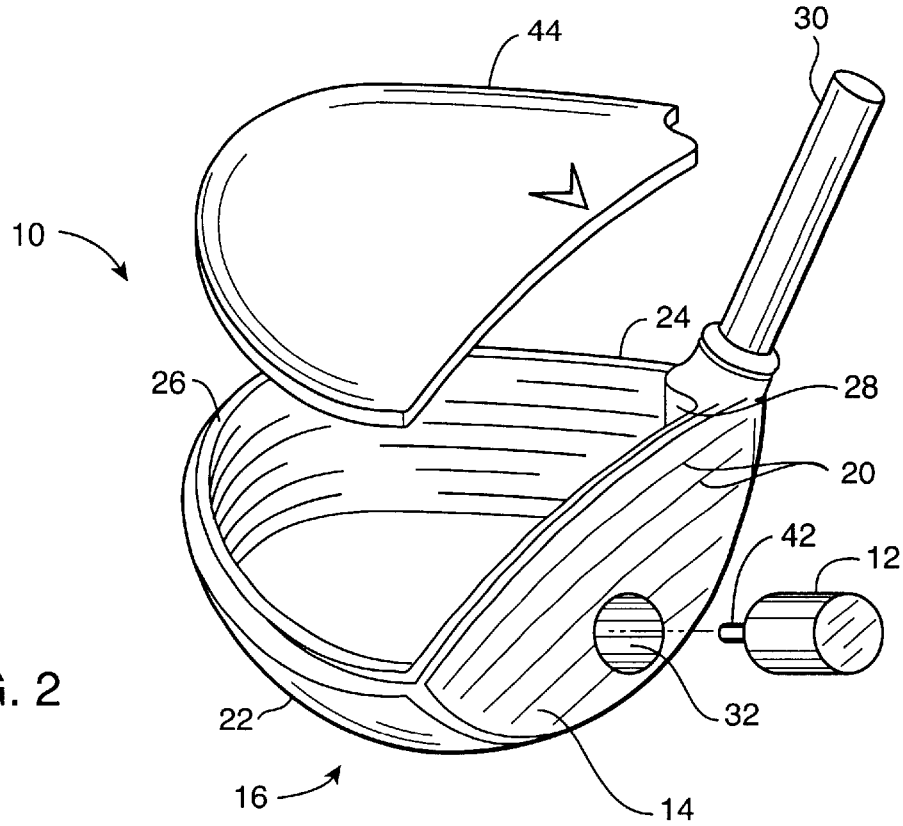
FIG. 2

FIG. 12
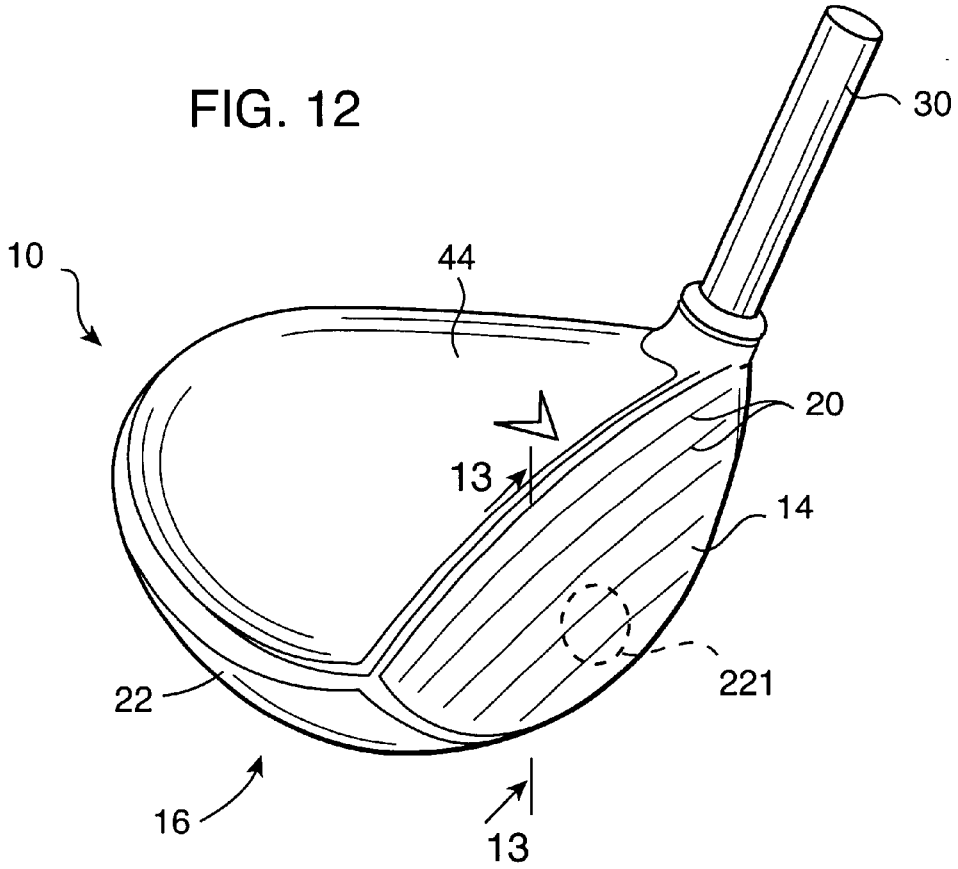
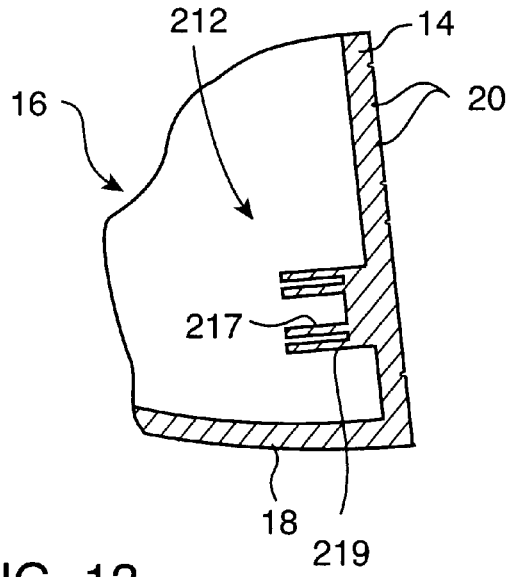
FIG. 13

METAL WOOD GOLF CLUB HEAD WITH FACEPLATE INSERT

This application claims the benefit of provisional application nos. 60/218,731, filed Jul. 17, 2000, and 60/286,323, filed Apr. 24, 2001.

BACKGROUND OF THE INVENTION

This invention relates generally to improvements in golf club head of the so-called metal wood type. More particularly, this invention relates to a metal wood style golf club head having a weighted insert on a faceplate thereof, wherein the weighted insert and/or the location thereof may be visible from the exterior of the club head.

Golf club heads of the metal wood type are generally known in the art, wherein the shape of a traditional wood-type club head is reproduced in the form of a hollow metal shell. In one typical construction, the club head comprises a base member which is formed by casting or forging or the like in an upwardly open shell-shaped configuration to define a lower sole plate joined to upstanding side walls, including a front face or faceplate for striking a golf ball. The base member additionally includes a hosel for suitable connection to the lower end of a golf club shaft. The top of the base member is closed by a metal cap plate which is typically welded thereto, to form the hollow metal head structure.

Significant development effort has been directed to improving metal wood style golf club heads, to improve distance, accuracy, and overall playability in different conditions. Much of this effort has been directed to enhancement of club head weight distribution, structural stiffness and aerodynamics. In this regard, weighted inserts have been proposed for mounting onto the club head in a strategic position, normally aligned substantially with an optimal ball impact point on the faceplate, to focus swing energy on the ball at the moment of impact. However, with metal wood club heads, such weighted inserts have normally been mounted in the hollow interior of the club head where they are not visible to the golfer.

The present invention relates to an improved golf club head of the metal wood type, wherein a weighted insert is mounted on or carried by the faceplate of the club head substantially at an optimal ball impact point, and further wherein the weighted insert and/or the location thereof may be visible from the club head exterior to provide the golfer with an easily recognized point of reference which assists in properly addressing the ball before a shot.

SUMMARY OF THE INVENTION

In accordance with the invention, a golf club head of the metal wood type is provided with a weighted insert mounted on or carried by the front impact face or faceplate of the club head. The weighted insert is positioned substantially at or in alignment with an optimum point of impact with a golf ball, for transmitting swing energy from the club head to the ball in a manner achieving substantially optimum stroke distance and accuracy. The weighted insert and/or the position thereof is desirably visible from the exterior of the club head to assist the golfer in properly addressing the ball prior to attempting a golf shot.

The club head generally comprises, in one preferred form, a generally shell-shaped lower base member formed from a selected metal such as titanium, titanium alloy, stainless steel, or the like by forging or casting to include a lower sole plate with upstanding walls at the front, rear, heel and toe sides thereof. The front wall of the base member defines the front impact face or faceplate of the club head for impacting a golf ball. In one form of the invention, a forwardly open and generally cylindrical cavity is formed in this faceplate at a generally centered position aligned substantially coaxially with the optimum point of ball impact. An inboard end of this cylindrical cavity is partially closed by an end wall having a small locking port formed therein.

The weighted insert comprises a metal slug formed from a selected material, such as the same material used for the club faceplate or an alternate material having a greater mass per unit volume relative to the material of the shell-shaped club head base member. In a preferred form, the metal insert slug has a generally cylindrical shape for sliding and substantially press-fit reception into the faceplate cavity of mating cylindrical shape. In the installed position, a front end of the insert slug is positioned substantially coplanar with the exterior surface of the faceplate, with a rear end of the insert slug bearing against the end wall at the inboard end of the cavity. Lock means are provided for securely affixing the insert slug within the faceplate cavity. A preferred lock means comprises a deformable tab projecting rearwardly from a rear end of the insert slug, to pass through the lock port formed in the inboard end wall, wherein this tab can be deformed as by peening or swaging to lock the insert slug securely within the faceplate cavity.

In an alternative preferred form, the weighted insert comprises a metal slug having a flanged cap sized and shaped to seat substantially flush within a recessed annular seat formed in the club head faceplate in surrounding relation to an open port formed in the faceplate. The metal slug has a generally cylindrical body for close-fit sliding reception into this faceplate port, with the flanged slug cap nested snugly within the faceplate annular seat. A cylindrical collar which can be formed from a selected material having a greater mass per unit volume than the faceplate material is slidably fitted over the slug body at an inboard side of the faceplate port, and a rear end of this collar is securely fastened in place as by welding, brazing, soldering, or swaging or the like at the rear end of the insert slug.

In a further alternative preferred form, the weighted insert may be formed integrally with the club head faceplate at an interior or inboard side thereof, in a position disposed generally in alignment with the optimum point of ball impact. A preferred integral insert geometry comprises at least one and preferably a concentric pair of rings formed integrally with the faceplate at the inboard side thereof, and projecting from the faceplate a short distance into the hollow interior of the club head. Suitable indicia may be provided on the exterior of the club head for indicating the position of the internal weighted to the golfer.

The golf club head further includes a hosel formed adjacent the heel side wall of the base member for secure attachment of a club shaft. The top of the base member is then closed by an upper metal cap plate as by welding.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a fragmented perspective view showing the top, front and toe sides of a metal wood style golf club head including a faceplate insert in accordance with the novel features of the invention;

FIG. 2 is a fragmented and exploded perspective view of the golf club head shown in FIG. 1;

FIG. 12 is a fragmented perspective view similar to FIG. 1, and showing a further alternative preferred form of the invention; and FIG. 13 is a fragmented vertical sectional view taken generally on the line 13—13 of FIG. 12.

DETAILED DESCRIPTION OF THE PREFERRED EMBODIMENTS

Figure 3:
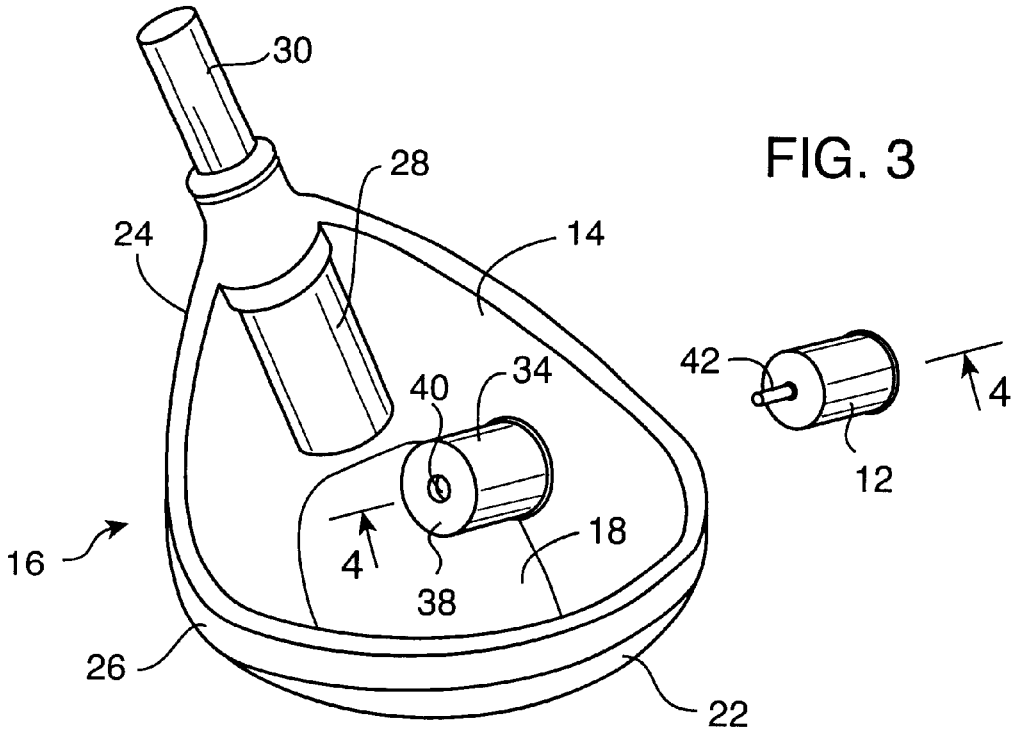
FIG. 3 is a fragmented and exploded perspective view of the golf club head, with an upper cap plate removed to illustrate the hollow interior geometry of a lower base member.

As shown in the exemplary drawings, an improved golf club head of the metal wood type referred to generally by the reference numeral 10 includes a weighted member or insert 12 mounted on a front impact face or faceplate 14 of the club head in a position visible from the club head exterior. The weighted insert 12 is positioned substantially at or in alignment with an optimum point of impact with a golf ball, for providing a golfer with an easily recognized point of reference which assists in properly addressing the ball before a shot. Upon striking the ball, the weighted insert 12 focuses the swing energy from the club to the ball in a manner achieving substantially optimum stroke distance and accuracy.

In one preferred form as shown in FIGS. 1–3, the club head 10 comprises a generally shell-shaped lower base member 16 formed from a selected metal such as titanium, titanium alloy, stainless steel, or the like by forging or casting to include a lower sole plate 18 joined integrally with upstanding walls at the front, rear, heel and toe sides thereof. More particularly, the sole plate 18 is joined to the upstanding front wall 14 forming the front impact face or faceplate for striking a golf ball, wherein the exterior surface of this faceplate 14 may incorporate an array of generally horizontally extending grooves 20 (FIGS. 1–2). The opposite side edges of the faceplate 14 are joined with an outer toe wall 22 and an inner heel wall 24, which are joined in turn respectively to opposite side edges of a rear wall 26. An internal tubular hosel 28 is normally formed within the shell-shaped hollow interior of the base member 16 for suitable connection to the lower end of a club shaft 30, in a manner known to persons skilled in the art.

Figure 5:
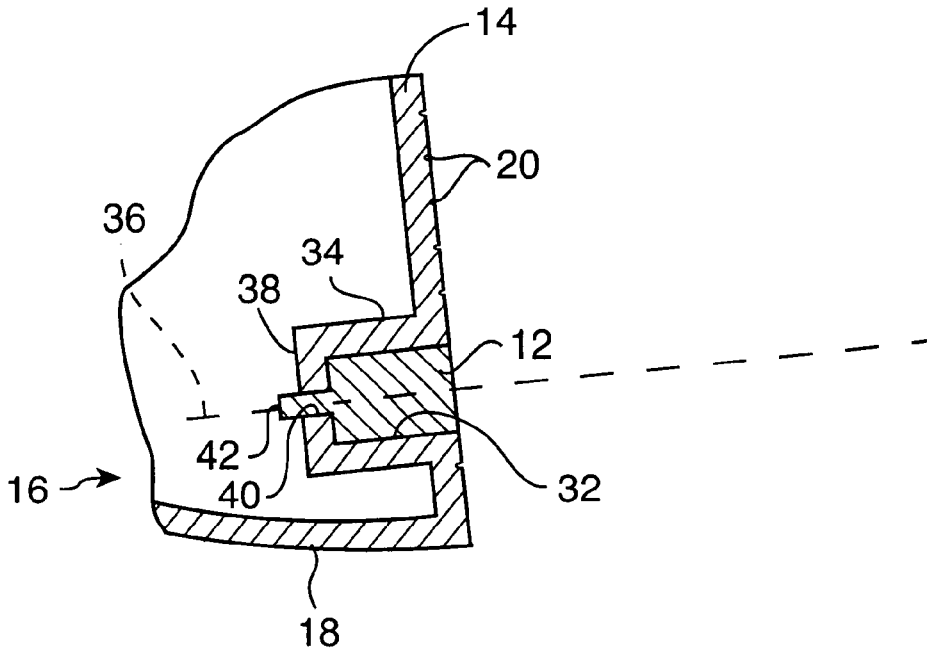
FIG. 5 is a fragmented sectional view similar to FIG. 4, but depicting the weighted insert seated within the faceplate cavity.
Figure 6:
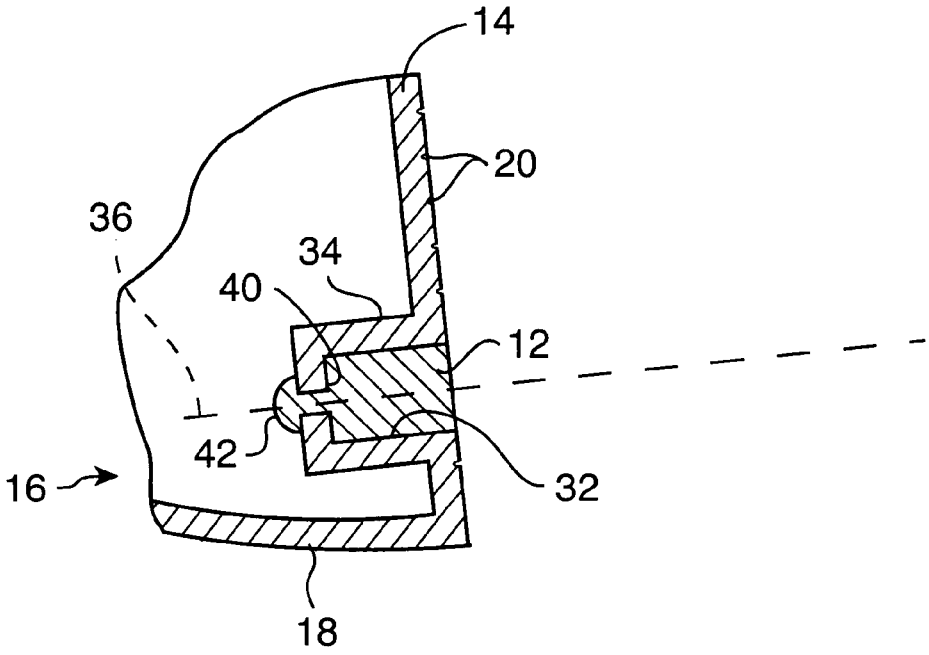
FIG. 6 is a fragmented sectional view similar to FIG. 5, but showing deformation of a lock member for securely locking the weighted insert within the faceplate cavity.
Figure 7:
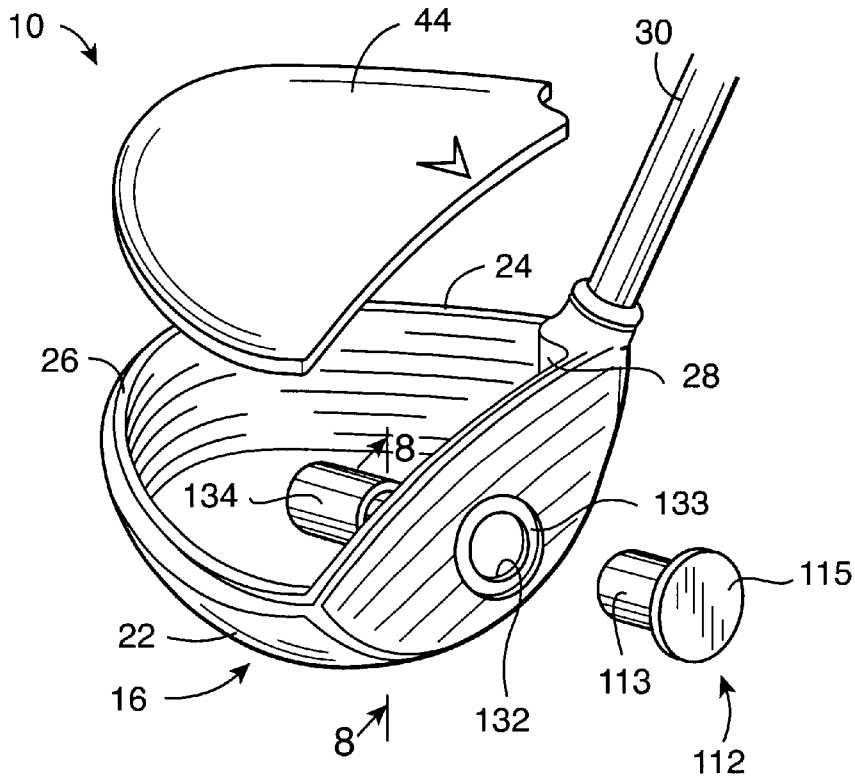
FIG. 7 is a fragmented perspective view similar to FIG. 1, but depicting an alternative preferred form of the invention.
Figure 8:
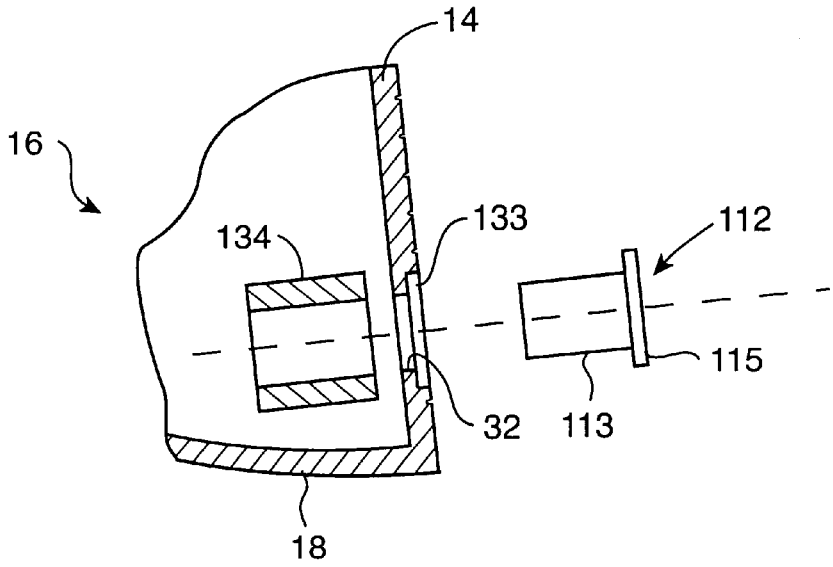
FIG. 8 is a fragmented and exploded vertical sectional view taken generally on the line 8—8 of FIG. 7.

The frontwall or faceplate 14 of the club head base member 16 has a forwardly open cavity 32 formed therein. As shown in the illustrative drawings, this forwardly open cavity 32 is defined by a generally cylindrical sleeve 34 formed integrally with the faceplate 14 and extending therefrom into the hollow interior of the base member 16. As shown best in FIGS. 4–6, this cylindrical sleeve 34 is formed on a central axis 36 extending substantially perpendicular to the exterior plane or surface of the faceplate 14, and further disposed substantially in coaxial alignment with an optimum point of impact with a golf ball, as will be described in more detail. A front end of the sleeve-defined cavity 32 terminates at the exterior surface of the faceplate 14, while a rear or inboard end is defined and partially closed by an inboard end wall 38 having a central lock port 40 formed therein substantially along the central axis 36. In a preferred configuration, the axial length of the cavity 32 is about 0.5 to about 1.0 inch, and the diameter is about 0.25 to about 0.75 inch.

Figure 4:
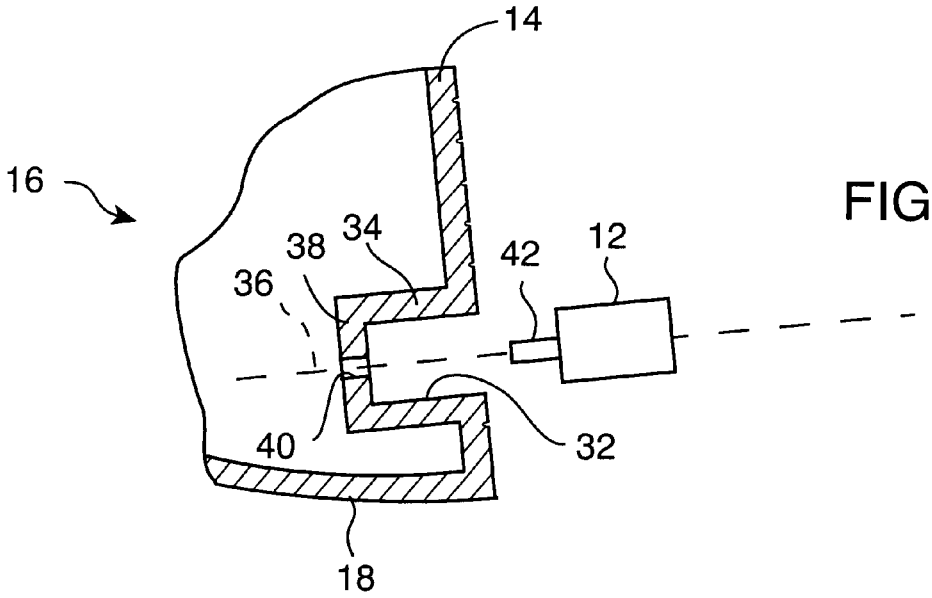
FIG. 4 is an enlarged fragmented sectional view taken generally on the line 4—4 of FIG. 3, and illustrating a weighted insert for mounting into a forwardly open cavity formed in a faceplate of the club head.

The weighted insert 12 comprises a metal slug formed from a selected material which may be the same as the material used to form the shell-shaped club head base member 16 and associated faceplate 14, or alternately the metal slug material may have a substantial and greater mass per unit volume relative to the comparatively lighter or less dense material of the shell-shaped club head base member 16 and associated faceplate 14. As one example, the metal insert 12 can be formed from brass or the like, with the base member 16 being formed from comparatively lightweight titanium or titanium alloy. In the preferred geometry as shown, the metal insert 12 has a generally cylindrical shape for sliding and substantially press-fit reception into the matingly shaped faceplate cavity 32 (FIGS. 2–4). In the installed position, a front end of the insert 12 is positioned substantially coplanar with the exterior surface of the faceplate 14 (FIGS. 1 and 5–6), with a rear end of the insert bearing and seated firmly against the end wall 38 at the inboard end of the cavity 32. Lock means are provided for securely affixing the insert 12 within the faceplate cavity 32, so that the insert 12 does not work loose over time in response to repeated striking impact with a golf ball. A preferred lock means comprises a deformable tab 42 projecting rearwardly from a rear end of the insert 12, to pass through the lock port 40 formed in the inboard end wall 38, wherein this tab 42 can be deformed as by peening or swaging or the like to lock the insert 12 securely within the faceplate cavity 32. Alternative lock means may be used, such as a welded connection or a screw fastener or the like passed through the lock port 40 into engagement with the insert 12.

Following seated placement of the weighted insert 12 within the faceplate cavity 32, and appropriate connection of a club shaft 30 to the tubular hosel 28, the hollow interior of the base member 16 can be closed by an upper metal cap plate 44 formed by forging or casting typically from a metal which is the same as or similar to the base member. In a common assembly technique, the cap plate 44 is securely fastened along its perimeter to the upper margins of the faceplate 14, the toe wall 20, the heel wall 22, and the rear wall 24 by welding.

The resultant golf club head 10 (FIG. 1) includes the weighted insert 12 having a front end disposed substantially coplanar with the exterior surface of the faceplate 14, whereby the insert 12 is thus visibly exposed. Importantly, the weighted insert 12 is strategically positioned so that it is centered substantially on the central axis 36, coincident with a substantially optimum point of impact for striking a golf ball to achieve substantially optimized stroke distance and accuracy. The weighted insert thus provides an easily visible and intuitive reference to the golfer for improved address alignment of the club head 10 with a golf ball prior to attempting a shot. Then, upon swinging the club to strike the faceplate 14 against the golf ball, the weighted insert 12 effectively focuses the swing energy for efficient transfer to the golf ball, in a manner providing improved stroke distance.

FIGS. 7–11 illustrate alternative preferred forms of the invention, wherein components common to those shown and described in FIGS. 1–6 are identified by the same reference numerals, and wherein functionally analogous components are identified by reference numerals increased by 100. As shown, the golf club head 10 comprises the lower shell-shaped base member 16 defining the front faceplate 14, the toe and heel walls 22 and 24, the rear wall 26, and the sole plate 18. The faceplate 14 has a centrally located faceplate port 132 circumscribed at the front side thereof by a relatively shallow annular recess 133. A modified weighted insert 112, which in this configuration is desirably formed from the same material as the base member 16 and associated faceplate 14, includes a generally cylindrical slug body 113 with a radially enlarged flanged cap 115 at a front end thereof.

The slug body 113 has a size and shape for close-fitting, substantially press-fit sliding reception into and through the central faceplate port 132, to position the flanged cap 115 in snug nested and seated reception into the faceplate recess 133. In this position, a rear end of the slug body 113 projects inwardly beyond the faceplate port 132 into the interior of the club head. A weighted sleeve member 134 is provided as a separate component and is slide-fitted or press-fitted over the slug body 113 to a position with a leading end of the sleeve member 134 snugly abutting the inboard side of the faceplate 14. In this position, as viewed in FIG. 9, the sleeve member 134 can be securely fastened in place by a suitable lock member 142, such as spot welds or a ring weld, or alternately by brazing, soldering, swaging, or the like. In a preferred form, the material used for the sleeve member 134 comprises a metal or metal alloy selected for weldability with the material used for the insert 112.

Figure 9:
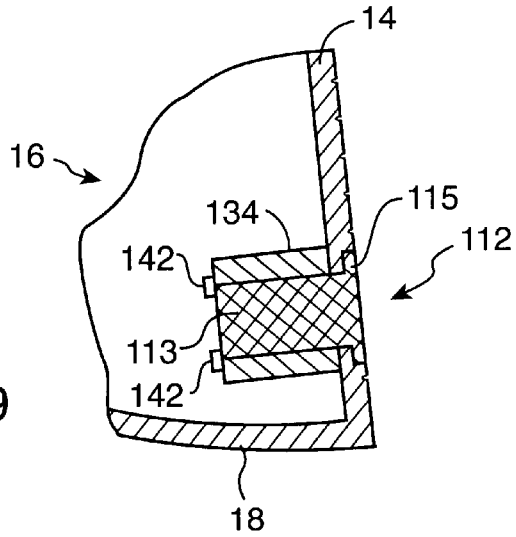
FIG. 9 is a fragmented vertical sectional view similar to FIG. 8, but showing the club head components in fully assembled relation.
Figure 10:
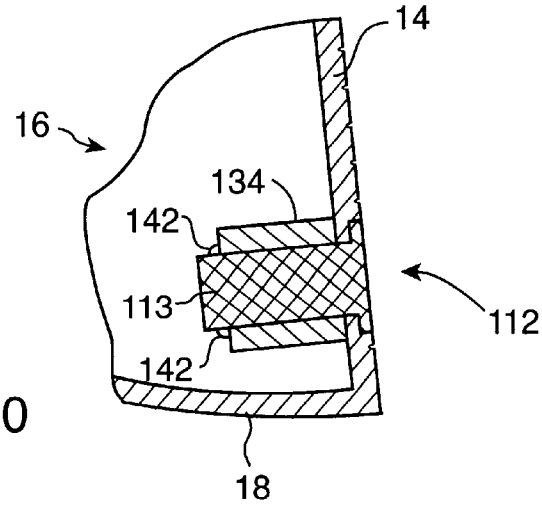
FIG. 10 is a fragmented vertical sectional view similar to FIG. 9, and illustrating another alternative preferred form of the invention.
Figure 11:
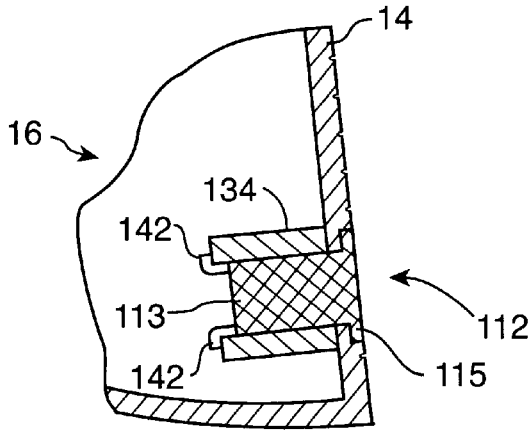
FIG. 11 is a fragmented vertical sectional view similar to FIGS. 9 and 10, and showing a further alternative preferred construction in accordance with the invention.

FIG. 9 shows the rear or inboard end of the slug body 113 terminating substantially in a common plane with a rear or inboard end of the weighted sleeve member 134. FIG. 10 illustrates the rear end of the slug body 113 protruding inwardly a short distance beyond the rear terminus of the sleeve member 134, while FIG. 11 shows the rear end of the sleeve member 134 protruding inwardly a short distance beyond the rear terminus of the slug body 113. In each configuration, the lock member 142 such as a weld or the like as described above securely interconnects the insert 112 and the sleeve member 134, or alternately locks the sleeve member 134 tightly between the lock member 142 and the inboard side of the faceplate 14, to hold the components securely in place. As a further alternative, it will be recognized and understood that the separate sleeve member 134 may be provided with a ported rear or inboard wall (not shown) and the lock member 142 can be provided in the form of a tab on the rear or inboard end of the slug body 113, similar to that shown and described in FIGS. 1–6.

A further alternative and preferred form of the invention is shown in FIGS. 12–13, wherein components common to those shown and described in FIGS. 1–11 are identified by the same reference numerals, and wherein functionally analogous components are identified by reference numerals increased by 200. In this embodiment, the golf club head 10 again comprises the lower shell-shaped base member 16 defining the front faceplate 14 with the array of grooves 20 formed therein, the toe and heel walls 22 and 24, the rear wall 26, and the sole plate 18. The weighted insert 212 (FIG. 13) is formed integrally at an interior or inboard side of the faceplate 14, as by integrally casting the insert 212 as a portion of the base member 16. Importantly, the weighted insert 212 is again positioned on an axis aligned with and centered on a substantially optimum point of ball contact for maximum stroke distance and accuracy. FIG. 13 shows the weighted insert 212 in the form of a concentric pair of rings 217 and 219 projecting rearwardly from the faceplate 14 into the hollow interior of the club head 10, in a direction generally perpendicular to the plane of the faceplate 14. Suitable indicia 221 (FIG. 12) such as a shallow laser-cut ring or other suitable marking may be and is desirably provided on the exterior of the faceplate 14 to indicate the position of the weighted insert 212 to the golfer. Persons skilled in the art will recognize and appreciate that alternative configurations for the internal integrated weighted insert 212 may be used.

The present invention beneficially permits the insert 12, 112, 212 to be formed from the same material as that used for the faceplate 14, in compliance with club specifications and regulations imposed by golf organizations. However, the overall mass of the weighted insert exceeds the mass otherwise provided by the thickness of the faceplate wall, thereby focusing the striking or impact force substantially at an optimum point of contact for maximum stroke distance and accuracy. The concentrated mass can be significantly and further increased by forming the interior-mounted sleeve member 134 shown in FIGS. 7–11 from a material having a per-volume mass greater than the material used for the club faceplate.

A variety of modifications and improvements in and to the improved golf club head of the present invention will be apparent to those persons skilled in the art. As one example, it will be recognized and understood that the an alternative shell-shaped base member may comprise an upper cap plate formed integrally with downwardly extending club head walls adapted for attachment to a lower sole plate. Accordingly, no limitation on the invention is intended by way of the foregoing description and accompanying drawings, except as set forth in the appended claims.

What is claimed is:

1. A golf club head, comprising:

a metal head formed from assembled head members to define, when assembled, a sole plate, a front faceplate and a rear wall and a heel segment and a toe segment generally upstanding from said sole plate and having upper margins thereof joined to a cap plate to define a substantially hollow enclosed head interior;

said faceplate having a central opening formed therein, said central opening being defined by a generally cylindrical sleeve extending from an inboard side of said faceplate a short distance into the hollow interior of said head;

a weighted member comprising a weighted insert mounted within said central opening formed in said faceplate and extending therefrom a short distance into the hollow interior of said head, said weighted insert being carried by said faceplate in a position generally in alignment with a substantially optimum point of impact between said faceplate and a golf ball, said weighted insert having an outboard end disposed substantially coplanar with and visible at an outboard side of said faceplate;

lock means for connecting said weighted insert to said sleeve; and indicia on an outboard side of said faceplate for visibly indicating the position of said weighted member to a golfer, said indicia comprising said outboard end of said weighted insert.

2. The golf club head of claim 1 wherein said weighted insert is carried by said faceplate on an axis disposed generally perpendicular to the outboard side of said faceplate.

3. The golf club head of claim 1 wherein said sleeve is formed integrally with said faceplate, and further wherein said lock means comprises means for connecting said weighted insert generally at an inboard end thereof to said sleeve generally at an inboard end thereof.

4. The golf club head of claim 3 wherein said lock means comprises an inboard end wall formed generally at an inboard end of said sleeve, said inboard end wall having a lock port formed therein, and a deformable tab carried generally at an inboard end of said weighted insert for slide-fit reception through said lock port, said tab being deformable subsequent to reception through said lock port for securely attaching said weighted insert to said inboard end wall of said sleeve.

5. The golf club head of claim 1 wherein said lock means comprises at least one weld.

6. The golf club head of claim 1 wherein said faceplate further defines a shallow recess formed in an outboard side thereof in surrounding relation to said central opening, said weighted insert having a radially enlarged flange for seated reception into said recess upon mounting of said weighted insert within said central opening.

7. The golf club head of claim 6 wherein said sleeve is formed as a component separate from said faceplate.

8. The golf club head of claim 6 wherein said lock means comprises at least one weld for securing said weighted insert to said sleeve.

9. A golf club head, comprising:

a metal head formed from assembled head members to define, when assembled, a sole plate, a front faceplate and a rear wall and a heel segment and a toe segment generally upstanding from said sole plate and having upper margins thereof joined to a cap plate to define a substantially hollow enclosed head interior;

said faceplate having a central opening formed therein;

a weighted member comprising a weighted insert mounted within said central opening formed in said faceplate and extending therefrom a short distance into the hollow interior of said head, said weighted insert being carried by said faceplate in a position generally in alignment with a substantially optimum point of impact between said faceplate and a golf ball, said weighted insert having an outboard end disposed substantially coplanar with and visible at an outboard side of said faceplate, and said weighted insert being formed from the same material as said faceplate; and indicia on an outboard side of said faceplate for visibly indicating the position of said weighted member to a golfer, said indicia comprising said outboard end of said weighted insert;

said weighted insert being formed from the same material as said faceplate.

10. In a golf club head having a metal head formed from assembled head members to define, when assembled, a sole plate, a front faceplate and a rear wall and a heel segment and a toe segment generally upstanding from said sole plate and having upper margins thereof joined to a cap plate to define a substantially hollow enclosed head construction, the improvement comprising:

a weighted member carried by and extending from said faceplate a short distance into the hollow interior of said head, said weighted member being carried by said faceplate on an axis disposed generally perpendicular to an outboard side of said faceplate and in a position generally in alignment with a substantially optimum point of impact between said faceplate and a golf ball; and indicia on the outboard side of said faceplate for visibly indicating the position of said weighted member to a golfer;

said faceplate having a central opening formed therein defined by a generally cylindrical sleeve extending from an inboard side of said faceplate a short distance into the hollow interior of said head, said sleeve having an inboard end wall with a lock port formed therein generally at an inboard end of said sleeve, and further wherein said weighted member comprises a weighted insert mounted within said sleeve with an outboard end of said weighted insert disposed substantially coplanar with the outboard side of said faceplate, said weighted insert further including a deformable tab carried generally at an inboard end thereof for slide-fit reception through said lock port, said tab being deformable subsequent to reception through said lock port for securely attaching said weighted insert to said inboard end wall of said sleeve.

11. In a golf club head having a metal head formed from assembled head members to define, when assembled, a sole plate, a front faceplate and a rear wall and a heel segment and a toe segment generally upstanding from said sole plate and having upper margins thereof joined to a cap plate to define a substantially hollow enclosed head construction, the improvement comprising:

a weighted member carried by and extending from said faceplate a short distance into the hollow interior of said head, said weighted member being carried by said faceplate on an axis disposed generally perpendicular to an outboard side of said faceplate and in a position generally in alignment with a substantially optimum point of impact between said faceplate and a golf ball; and indicia on the outboard side of said faceplate for visibly indicating the position of said weighted member to a golfer;

said faceplate further defining a shallow recess formed in an outboard side thereof in surrounding relation to said central opening, said weighted insert having a radially enlarged flange for seated reception into said recess upon mounting of said weighted insert within said central opening, and further including a generally cylindrical sleeve extending from an inboard side of said faceplate a short distance into the hollow interior of said head, and lock means for connecting said weighted insert to said sleeve.

12. The golf club head of claim 11 wherein said lock means comprises at least one weld for securing said weighted insert to said sleeve.

* * * * *